US006233439B1

(12) United States Patent
Jalali

(10) Patent No.: US 6,233,439 B1
(45) Date of Patent: May 15, 2001

(54) SIGNAL TO NOISE ESTIMATION OF FORWARD LINK TRAFFIC CHANNEL FOR FAST POWER CONTROL

(75) Inventor: Ahmad Jalali, Plano, TX (US)

(73) Assignee: Nortel Networks Limited, Montreal (CA)

( * ) Notice: Subject to any disclaimer, the term of this patent is extended or adjusted under 35 U.S.C. 154(b) by 0 days.

(21) Appl. No.: 09/128,061

(22) Filed: Aug. 3, 1998

Related U.S. Application Data

(60) Provisional application No. 60/081,114, filed on Apr. 8, 1998.

(51) Int. Cl.[7] ..... H01Q 11/12

(52) U.S. Cl. ..... 455/127; 455/67.1; 455/69; 455/522

(58) Field of Search ..... 455/522, 69, 115, 455/127, 67.1; 370/332, 333; 375/130, 140, 141

(56) References Cited

U.S. PATENT DOCUMENTS 5,245,629 * 9/1993 Hall ..... 455/522
5,267,262 * 11/1993 Wheatley, III ..... 455/69
5,461,639 * 10/1995 Wheatley, III et al. ..... 455/522
5,603,096 * 2/1997 Gilhousen et al. ..... 455/522
5,604,730 * 2/1997 Tiedemann, Jr. ..... 455/69
5,745,520 * 4/1998 Love et al. ..... 375/200
5,768,684 * 6/1998 Grubb et al. ..... 455/522
5,933,781 * 8/1999 Willenegger et al. ..... 455/69
5,963,870 * 10/1999 Chheda et al. ..... 455/522

* cited by examiner

*Primary Examiner*—Nguyen Vo
*Assistant Examiner*—Marsha D. Banks-Harold
(74) *Attorney, Agent, or Firm*—John D. Crane

(57) ABSTRACT

The $^{E}b/N_{o}$ estimation process generates two streams of power control bits that are transmitted to the base station. One of the power control bit streams is generated under the assumption that the frame rate has not changed. The other power control bit stream is generated under the assumption that the frame rate has changed. The base station, knowing whether or not the frame rate changed, chooses the appropriate stream to use in controlling the base station transmit power.

13 Claims, 2 Drawing Sheets

SIGNAL TO NOISE ESTIMATION OF FORWARD LINK TRAFFIC CHANNEL FOR FAST POWER CONTROL

RELATED APPLICATIONS

This application claims the benefit of U.S. Provisional Application Ser. No. 60/081,114, filed Apr. 8, 1998.

BACKGROUND OF THE INVENTION

I. Field of the Invention

The present invention relates to radio communications. More particularly, the present invention relates to fast forward link power control in a code division multiple access system.

II. Description of the Related Art

Multiple access techniques are efficient techniques for utilizing the limited radio frequency spectrum. Examples of such techniques include time division multiple access (TDMA), frequency division multiple access (FDMA), and code division multiple access (CDMA).

CDMA employs a spread spectrum technique for the transmission of information. A spread spectrum system uses a technique that spreads the transmitted signal over a wide frequency band. This frequency band is typically substantially wider than the minimum bandwidth required to transmit the signal.

Frequency diversity is obtained by spreading the transmitted signal over a wide frequency range. Since only part of a signal is typically affected by a frequency selective fade, the remaining spectrum of the transmitted signal is unaffected. A receiver that receives the spread spectrum signal, therefore, is affected less by the fade condition than a receiver using narrowband signals.

The spread spectrum technique is accomplished by modulating each base band data signal to be transmitted with a unique wide band spreading code. Using this technique, a signal having a bandwidth of only a few kilohertz can be spread over a bandwidth of more than a megahertz. Typical examples of spread spectrum techniques are found in M. K. Simon, *Spread Spectrum Communications*, Volume I, pp. 262–358.

In a CDMA-type radiotelephone system, multiple signals are transmitted simultaneously at the same frequency. A particular receiver then determines which signal is intended for that receiver by a unique spreading code in each signal. The signals at that frequency, without the particular spreading code intended for that particular receiver, appear to be noise to that receiver and are ignored.

Since multiple radiotelephones and base stations transmit on the same frequency, power control is an important component of the CDMA modulation technique. A higher power output by a radiotelephone and/or base station increases the interference experienced by the other radiotelephones and base stations in the system. In order to keep the radiotelephones and base stations from transmitting at too much power, thereby lowering system capacity, some form of power control must be implemented.

The radiotelephone can aid the base station in the control of the power on the forward link (from the base station to the radiotelephone) by transmitting a power control message to the base station on the reverse link (from the radiotelephone to the base station). The radiotelephone gathers statistics of its error performance and informs the base station via a power control message. The base station may then adjust its power level to the specific user accordingly.

In a typical CDMA cellular communication system that follows the Telecommunications Industries Association/Electronic Industries Association Interim Standard 95 (IS-95), the base station adjusts its forward link power at a rate no faster than once per frame. This results in a high required $^{E}b/N_o$ on the forward link during low speed travel of the radiotelephone, due to the effects of Rayleigh fading, since the radiotelephone remains in the fade longer.

The ratio $^{E}b/N_o$ is a standard quality measurement for digital communications system performance. The ratio expresses the bit-energy-to-noise-density of the received signal. $^{E}b/N_o$ can be considered a metric that characterizes the performance of one communication system over another; the smaller the required $^{E}b/N_o$ the more efficient is the system modulation and detection process for a given probability of error. A more detailed discussion of this concept can be seen in B. Sklar, *Digital Communications, Fundamentals and Applications*, Chapter 3 (1988).

Data frames communicated between base stations and a mobile radiotelephone are divided into groups of consecutive coded bits where each group is referred to as a power control group. In IS-95 CDMA, the power control groups are 1.25 ms long. The length of the power control group is typically equal to the frame length divided by the number of power control updates per frame.

This power control scheme estimates the received $^{E}b/N_o$ over a power control group of 1.25 ms for the 800 Hz power control updates. The estimate is compared against an $^{E}b/N_o$ threshold referred to as the $(^{E}b/N_o)_{set\ point}$. Up or down power control bits are generated by the mobile radiotelephone as a result of the comparison. The $(^{E}b/N_o)_{set\ point}$ is updated after each frame is decoded.

The $(^{E}b/N_o)_{set\ point}$ is increased by a predetermined amount, Step_Up, if the frame just decoded was in error and decreased by another predetermined amount, Step_Down, if the frame was received correctly. Step_Up and Step_Down are related as follows:

$$Step_Down = \frac{Step_Up}{1/(Target_FER - 1)};$$

where Target_FER is the frame error rate (FER) that the power control process is trying to achieve.

The power control bits are transmitted to the base station where the power is adjusted according to the value of the power control bits. The power control bits to control the power on the forward link are sent on a separate control channel. Therefore, unlike the control of the reverse link power, where power control bits are punctured on the forward link traffic channel, the forward link power control command bits are not punctured on the reverse link traffic channel.

To estimate the $^{E}b/N_o$, the received signal power and the received interference need to be estimated. Since the data on the pilot channel is known, the received interference can be easily estimated from the pilot channel. Once an estimate of the interference is available, the estimate of the received signal power must be made.

The estimate of the signal power over a power control group may be made from the traffic channel if the data rate of the current frame is known. However, in a variable rate voice call, the data rate is not known for the frame until the frame has been decoded. A previously unknown need exists to determine a reliable estimate of the signal power for a traffic channel.

SUMMARY OF THE INVENTION

The present invention encompasses a power control process in a wireless communication system. The communication system comprises a base station and a radiotelephone. The base station and radiotelephone communicate using data frames transmitted at various frame rates over traffic channels.

The process begins by estimating the forward link interference from the pilot channel. The received traffic channel data is used to estimate a first received signal energy. A second received signal energy is estimated using the power control bits transmitted over the forward link.

A first quality metric is determined using the received interference and the first received signal energy. A second quality metric is determined using the received interference and the second received signal energy. In the preferred embodiment, the quality metrics are $^{E}b/N_o$ values.

The two estimated quality metrics are then used to generate two different power control bit streams. The power control bits are based on the comparison of the two estimated quality metrics with a predetermined threshold, $(^{E}b/N_o)_{setpoint}$. One power control bit stream is generated under the assumption that the frame rate has not changed while the other power control bit stream is generated under the assumption that the frame rate has changed. These power control bit streams are transmitted to the base station.

The base station adjusts the transmit power in response to one of the power control command streams. If the frame rate had changed, the power control bit stream that was generated under this assumption is used. If the frame rate did not change, the power control bit stream that was generated under this assumption is used.

DETAILED DESCRIPTION OF THE PREFERRED EMBODIMENT

Figure 1:
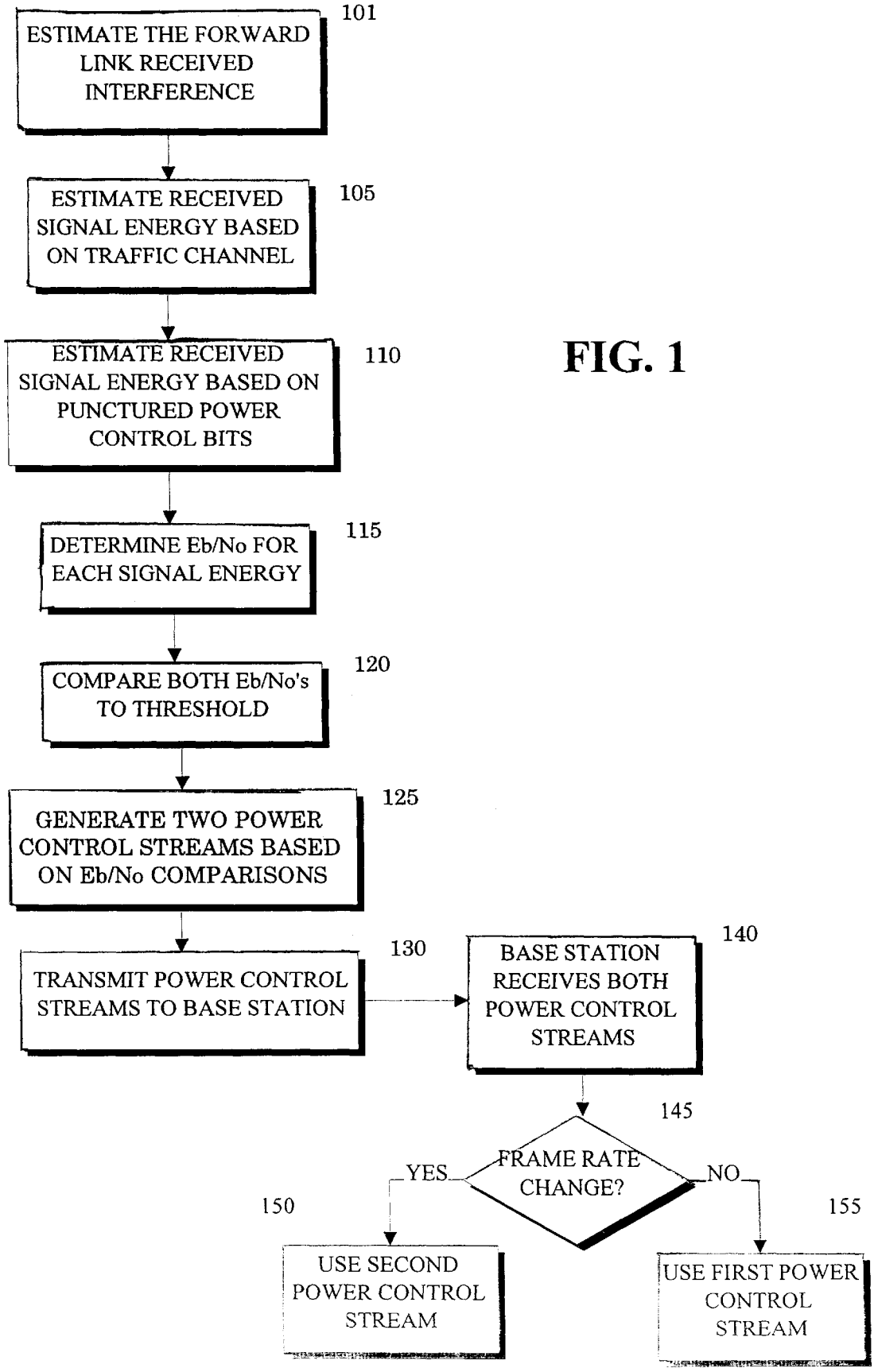
FIG. 1 shows a flowchart of the power control process of the present invention.

The forward link power control command bit generation process of the present invention is illustrated in the flowchart of FIG. 1. In this process, the radiotelephone generates two streams of power control bits that are transmitted to the base station. The base station then chooses the appropriate stream to use in controlling the base station transmit power.

The radiotelephone generates the first stream of power control bits by estimating the received signal energy based on all traffic channel bits. This is done assuming that the current frame rate has not changed from the previous frame rate.

The radiotelephone generates the second stream of power control bits by estimating the received signal energy from the punctured power control bits on the forward link as well as a subset of the traffic channel bits. As is well known in the art, the punctured power control bits are transmitted at full power regardless of the data rate of the frame. The punctured power control bits are transmitted by the base station to instruct the radiotelephone to adjust its transmit power to an appropriate level based on the power received at the base station.

In the preferred embodiment, the estimation of the received signal energy based on both the traffic channel bits and the punctured power control bits is performed using the same technique. This technique relies on the integration of the bits over a predetermined time interval. The integration technique is well known in the art and is not discussed further.

The frame rate of data transmitted from the base station to the radiotelephone changes when the voice activity changes. During active conversation, the frame rate is at full rate. When a lull in the conversation occurs, the frame rate drops to eighth rate. The base station knows these different frame rates since it is the source of the frames. Also, as is well known in the art, the base station reduces its transmit power when the frame rate is reduced.

When the radiotelephone detects a decrease in received power, it transmits power-up commands to the base station since it does not know if the power was reduced due to a fade or due to a reduction in the frame rate. The radiotelephone cannot determine until the frame has been decoded that the power has gone down due to a frame rate decrease. This is because the radiotelephone must wait until the end of the frame to decode it, thereby determining the frame rate. During this time, 16 power control groups have passed.

When the frame rate changes, the base station uses the power control command bits received from the radiotelephone that are in the second stream of power control bits. Since the base station knows that the rate has changed and that the radiotelephone generated the second power control bit stream based on the assumption that the rate has changed, the base station knows to use the second power control bit stream.

Additionally, if the frame rate has not changed, the base station uses the power control command bits received from the radiotelephone that are in the first power control bit stream. Since the base station knows that the frame rate has not changed and that the radiotelephone generated the first power control bit stream based on the assumption that that rate has not changed, the base station knows to use the first power control bit stream.

Referring to FIG. 1, the process begins by the radiotelephone estimating the received interference (step 101). As is well known in the art, this can be easily estimated from the pilot channel. Alternate embodiments use other ways to estimate the received interference.

The radiotelephone then estimates the received signal energy (step 105) based on the traffic channel bits assuming that the rate of the current frame is the same as the previous frame. The received signal energy is also estimated based on the punctured power control bits on the forward link (step 110).

The radiotelephone then determines two $^{E}b/N_o$ values for the present power control group (step 115) using each of the just estimated signal and interference energy values. These $^{E}b/N_o$ values are then compared (step 120) with the desired $^{E}b/N_o$ threshold, $(^{E}b/N_o)_{setpoint}$. This threshold is determined as discussed above.

The two power control command bit streams are generated that instruct the base station to change its transmit power (step 125). These power control bit streams are based on the comparison of each estimated $^{E}b/N_o$ with the threshold. If the estimated $^{E}b/N_o$ is greater than the threshold, the radiotelephone generates power control command bits (step 125) to instruct the base station to decrease its transmit power. If the estimated $^{E}b/N_o$ is less than the threshold, the radiotelephone generates power control command bits (step 125) to instruct the base station to increase its transmit power.

Both power control command bit streams are transmitted to the base station over the reverse link. In the preferred embodiment, the command bits are transmitted on a separate power control channel. An alternate embodiment punctures the data on the traffic channel.

The base station receives both power control command streams (step 140). If the data rate of the last frame changed (step 145), the base station will use the power command bits in the second stream (step 150) (i.e., the stream generated from the punctured power control command bits) for power control purposes. The base station chooses this stream since it knows that the frame rate changed and the second power control command stream was generated under this assumption.

If the data rate of the last frame has not changed (step 145), the base station uses the power command bits in the first stream (step 155). This stream was generated with the assumption that the change in received power was due to a fade and or leaving a fade and not due to a frame rate change.

In an alternate embodiment, each reverse link frame contains a bit that indicates whether the last frame received on the forward link was error free. Since the radiotelephone may have received, in error, the frame whose rate was different from the previous frame, the base station will use the power control command bits in the second stream. This is true until it receives a bit in the reverse link frame acknowledging that at least one frame with the new rate has been received correctly by the radiotelephone. At this time, the base station will use the power control command bits in the first stream described above to control the transmit power from the base station.

In another alternate embodiment, the mobile uses a subset of the traffic channel bits in a power control group to estimate the signal energy and thus generate the second power control command stream. This further optimizes the performance of the process of the present invention.

In this embodiment, the base station must transmit, at full rate power regardless of the frame rate, the subset of traffic channel bits that are used by the radiotelephone for signal power estimation. However, to optimize performance and minimize transmission power, the base station may transmit at a lower power on the subset of traffic channel bits. These lower data rates occur when the base station is utilizing the power control command bits in the first stream transmitted by the radiotelephone.

In yet another alternate embodiment, other criteria besides frame rate change are used to determine whether to use the first or the second power control command streams. Such embodiments may require determining the new frame rate or other factors in determining which power control command stream to use.

In yet another alternate embodiment, the present invention operates with a related quality metric, ${}^{E}s/N_o$. This is the ratio of symbol-energy-to-noise-density of the received signal. ${}^{E}s/N_o$ is related to ${}^{E}b/N_o$ by:

$$E_S / N_O = (E_b / N_O)N$$

where N is the number of bits per symbol. In binary phase shift keying (BPSK) modulated communication systems, N=1 and, consequently, ${}^{E}s/N_o={}^{E}b/N_o$. In quadrature phase shift keying (QPSK) modulated communication systems, N=2 so that ${}^{E}s/N_o=2({}^{E}b/N_o)$. Because symbols are actually transmitted, it may be more convenient to use ${}^{E}s/N_o$ then convert to ${}^{E}b/N_o$ if desired. Other alternate embodiments use other quality metrics in place of ${}^{E}b/N_o$ of the present invention.

Figure 2:
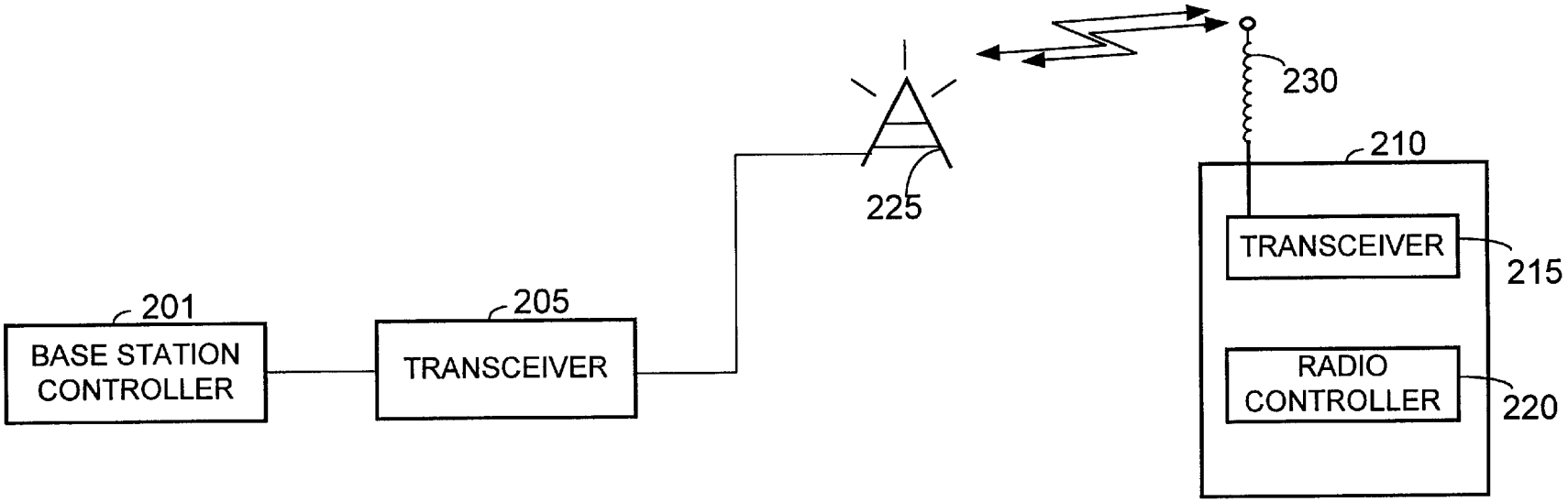
FIG. 2 shows a block diagram of a radiotelephone communication system of the present invention.

FIG. 2 illustrates a block diagram of the radiotelephone communication system in which the process of the present invention operates. The fixed base station is comprised of a number of radio transmitters and receivers (205) that transmit and receive the radiotelephone signals through the antenna (225). The radio frequency tuning and transmit power control is controlled by the base station controller (201).

The base station communicates data frames with the radiotelephone (210). In the preferred embodiment, the radiotelephone (210) is mobile. Alternate embodiments use fixed radiotelephones such as is used in a fixed wireless access system.

The radiotelephone is comprised of a transceiver (210) for communicating the radiotelephone signals through its antenna (230). The radiotelephone is controlled by the radiotelephone controller (220).

I claim:

1. A method for estimating quality metrics in a wireless communication system comprising a base station and a radiotelephone, each quality metric comprising a received interference and a received signal energy, the base station and radiotelephone communicating using frames transmitted at various frame rates over a traffic channel, the method comprising the steps of:

estimating the received interference in response to received frames;

estimating a first received signal energy in response to the traffic channel frames;

estimating a second received signal energy in response to power control bits transmitted from the base station;

determining a first quality metric in response to the received interference and the first received signal energy; and determining a second quality metric in response to the received interference and the second received signal energy.

2. The method of claim 1 wherein the quality metrics include ${}^{E}b/N_o$.

3. A method for generating power control commands in a wireless communication system comprising a base station and a radiotelephone, the base station and radiotelephone communicating using frames transmitted at various frame rates over traffic channels, the method comprising the steps of:

estimating a received interference of a traffic channel in response to received frames;

estimating a first received signal energy in response to the received frames;

estimating a second received signal energy in response to power control bits transmitted from the base station;

determining a first quality metric in response to the received interference and the first received signal energy;

determining a second quality metric in response to the received interference and the second received signal energy;

generating a first power control command stream in response to the first quality metric; and generating a second power control command stream in response to the second quality metric.

4. A method for power control in a wireless communication system comprising a base station and a radiotelephone, the base station and radiotelephone communicating using frames transmitted at various frame rates over traffic channels, the method comprising the steps of:

estimating a received interference of a traffic channel in response to received frames;

estimating a first received signal energy in response to the received frames;

estimating a second received signal energy in response to power control bits transmitted over the traffic channel from the base station;

determining a first quality metric in response to the received interference and the first received signal energy;

determining a second quality metric in response to the received interference and the second received signal energy;

generating a first power control command stream in response to the first quality metric;

generating a second power control command stream in response to the second quality metric;

transmitting the first and second power control command streams to the base station; and the base station adjusting transmit power in response to one of the first or the second power control command streams.

5. The method of claim 4 and further including the steps of:

the base station determining if the frame rate has changed; and if the frame rate has changed, using the second power control command stream to adjust the transmit power.

6. The method of claim 5 and further including the step of if the frame rate has not changed, using the first power control command stream to adjust the transmit power.

7. A wireless communication system comprising a base station and a radiotelephone, the base station and radiotelephone communicating using frames transmitted at various frame rates over traffic channels, the system comprising:

means for estimating a received interference of a traffic channel in response to received frames;

means for estimating a first received signal energy in response to the received frames;

means for estimating a second received signal energy in response to power control bits transmitted over the traffic channel from the base station;

means for determining a first and a second quality metric in response to the received interference and the first and the second received signal energies;

means for generating a first and a second power control command stream in response to the first and second quality metrics respectively;

means for transmitting the first and second power control command streams to the base station; and means at the base station for adjusting transmit power in response to one of the first or the second power control command streams.

8. A method for power control in a base station that communicates with a radiotelephone using frames transmitted at various frame rates over traffic channels, the radiotelephone generating only two different power control command streams, one power control command stream for a change in frame rate and one power control command stream for no change in frame rate, the method comprising the steps of:

receiving the two power control command steams from the radiotelephone;

choosing one of the two power control command streams in response to a predefined traffic channel condition; and the base station adjusting its transmit power, prior to frame transmission, in response to the chosen power control command stream.

9. The method of claim 8 wherein the predefined traffic channel condition is defined by a quality metric.

10. The method of claim 9 wherein the quality metric is a ratio of symbol-energy-to-noise-density of the traffic channel.

11. The method of claim 9 wherein the quality metric is a ratio of bit-energy-to-noise-density of the traffic channel.

12. The method of claim 8 wherein the predefined traffic channel condition is a Rayleigh fade.

13. The method of claim 8 wherein the predefined traffic condition is a change in frame rate over the channel.

* * * * *